United States Patent [19]

Liu

[11] Patent Number: 4,870,982

[45] Date of Patent: Oct. 3, 1989

[54] ULTRASONIC CLEANING APPARATUS FOR HOUSEHOLD USE

[75] Inventor: Chung-Chi Liu, Brea, Calif.

[73] Assignee: Tatung Company of America, Inc., Long Beach, Calif.

[21] Appl. No.: 294,864

[22] Filed: Jan. 9, 1989

[51] Int. Cl.[4] ..... B08B 3/12

[52] U.S. Cl. ..... 134/135; 68/3 SS; 134/1; 134/184; 366/127

[58] Field of Search ..... 134/1, 135, 184; 68/3 SS; 366/127

[56] References Cited

U.S. PATENT DOCUMENTS

| | | | |
|---|---|---|---|
| 1,239,834 | 9/1917 | Smith | 134/135 |
| 2,974,070 | 3/1961 | Van Dongeren | 134/1 |
| 3,113,761 | 12/1963 | Platzman | 134/1 X |
| 3,595,532 | 7/1971 | Doyle et al. | 68/3 SS X |
| 3,937,236 | 2/1976 | Runnells | 134/184 |
| 4,716,824 | 1/1988 | Hand et al. | 134/135 X |
| 4,732,187 | 3/1988 | Monch | 134/135 |

FOREIGN PATENT DOCUMENTS

| | | | |
|---|---|---|---|
| 1416979 | 12/1975 | United Kingdom | 134/184 |

*Primary Examiner*—Philip R. Coe
*Attorney, Agent, or Firm*—Gene W. Arant

[57] ABSTRACT

An ultrasonic cleaning apparatus for household use is small and compact, easy to use, and inexpensive to buy and to operate. It includes a base, an electric circuit supported upon the base, a circumferential housing extending upward from the base, a liquid tank within the upper portion of the housing, and an electromechanical transducer secured to the bottom side of the liquid tank and coupled to the eletric circuit to be driven thereby. The periphery of the liquid tank is supported from the housing in secure liquid-sealing relationship so as to protect the electric circuit from any liquid spillage. A removable cover fits over the top of the housing and covers the liquid tank and contents.

A separate feature of the invention is a removable jewelry basket which may be positioned within the liquid tank for holding jewelry that is being cleaned, but can then be rested above the tank while the liquid drains out and the jewelry dries.

10 Claims, 3 Drawing Sheets

Fig. 3.
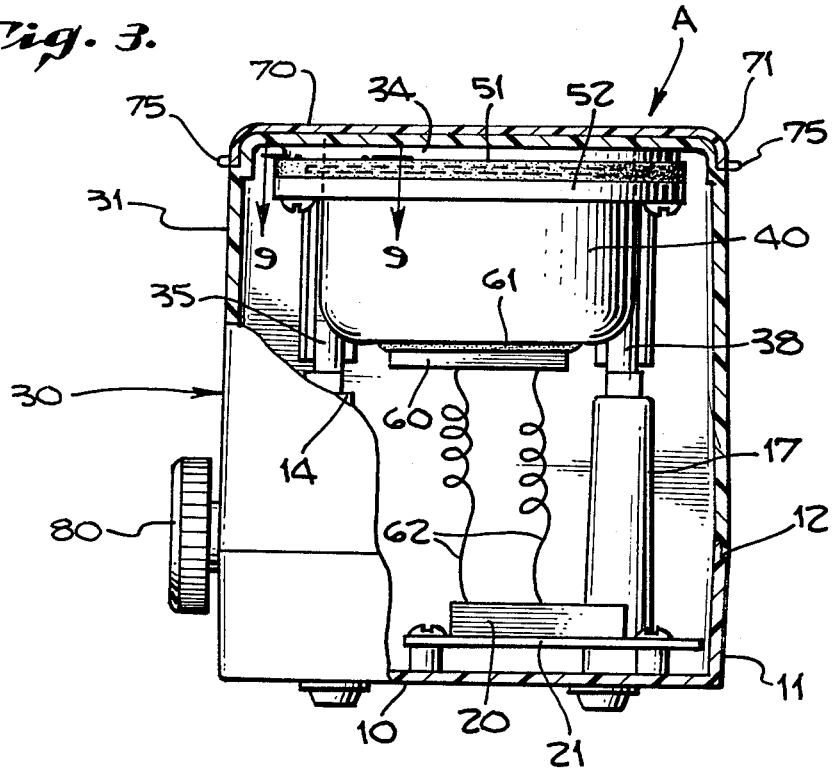
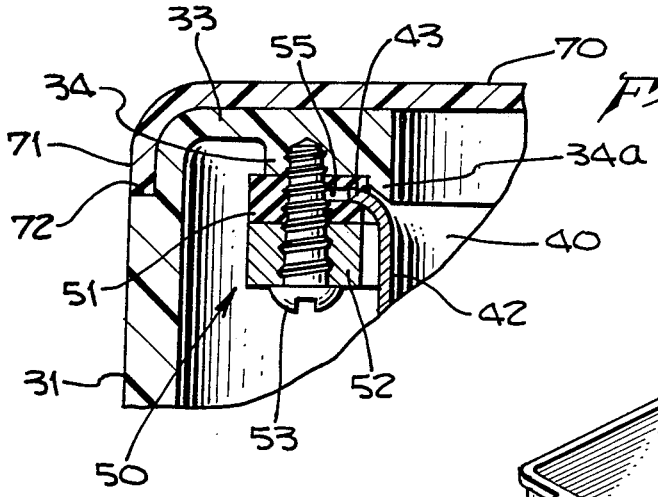
Fig. 4.
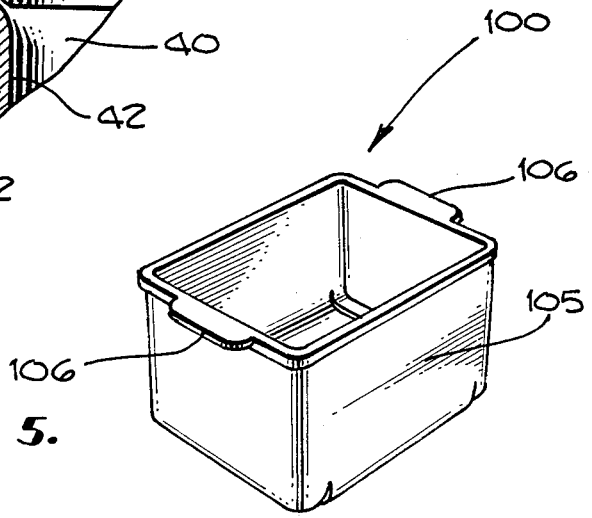
Fig. 5.

ULTRASONIC CLEANING APPARATUS FOR HOUSEHOLD USE

BACKGROUND OF THE INVENTION

It has been known for some decades to utilize ultrasonic vibrations within a liquid body to accomplish the cleaning or the lubrication of objects that are immersed within the liquid.

In particular, ultrasonic cleaning apparatus has been extensively used in dental offices for cleaning dental instruments, and in jewelry establishments for cleaning items of jewelry.

A need has now arisen for an ultrasonic cleaning apparatus for household use, which is small and compact, easy to use, and inexpensive to buy and to operate.

SUMMARY OF THE INVENTION

The present invention provides an ultrasonic cleaning apparatus for household use which is small and compact, easy to use, and inexpensive to buy and to operate.

Apparatus in accordance with the invention includes a base, an electric circuit supported upon the base, a circumferential housing extending upward from the base, a liquid tank within the upper portion of the housing, means supporting the periphery of the liquid tank from the housing in secure liquid-sealing relationship, and an electro-mechanical transducer secured to the bottom side of the liquid tank and coupled to the electric circuit to be driven thereby. A removable cover fits over the top of the housing and covers the liquid tank and contents.

More specifically, the various parts of the apparatus are arranged for maximum convenience in assembling and using the apparatus, for minimum manufacturing cost, and for maximum useful life.

A separate feature of the invention is a removable jewelry basket which may be positioned within the liquid tank for holding jewelry that is being cleaned, but can then be rested above the tank while the liquid drains out and the jewelry dries.

DRAWING SUMMARY

FIG. 3 is a transverse cross-sectional view taken on the line 3—3 of FIG. 2;

FIG. 4 is a fragmentary cross-sectional view taken on the line 4—4 of FIG. 1;

FIG. 5 is a perspective view of the jewelry basket;

DETAILED DESCRIPTION—BASIC MACHINE

FIGS. 1–4 & 9

Figure 1:
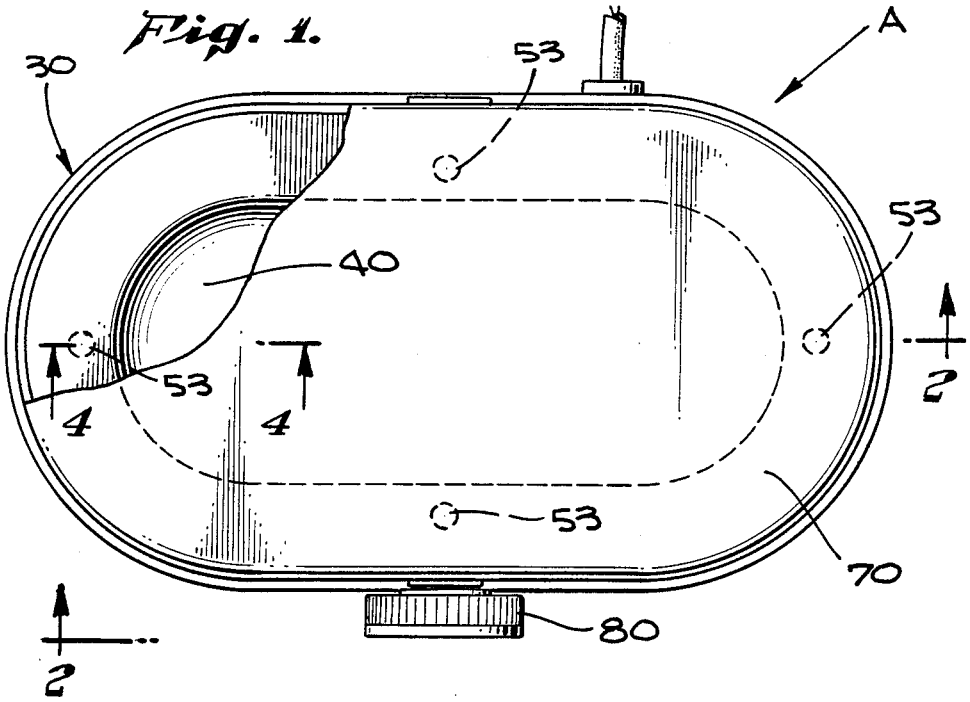
FIG. 1 is a top plan view of the apparatus, but with the removable cover member partially cut away.

Reference is now made to the drawings, FIGS. 1 through 4, inclusive, and 9, which illustrated the basic machine of the present invention.

The ultrasonic cleaning apparatus designated A includes a base 10, an electric circuit 20 supported upon the base, a circumferential housing 30 which is supported upon the base and extends upwardly from it, a liquid tank 40 disposed within the upper portion of the housing above the electric circuit, sealing and support means 50 supporting the periphery of the liquid tank from the housing in secure liquid-sealing relationship, an electro-mechanical transducer 60 secured to the bottom side of the liquid tank and coupled to the electric circuit to be driven thereby, and a removable cover 70 which normally fits over the top of the housing and covers the liquid tank and contents. These various parts will now be described in more detail.

Figure 2:
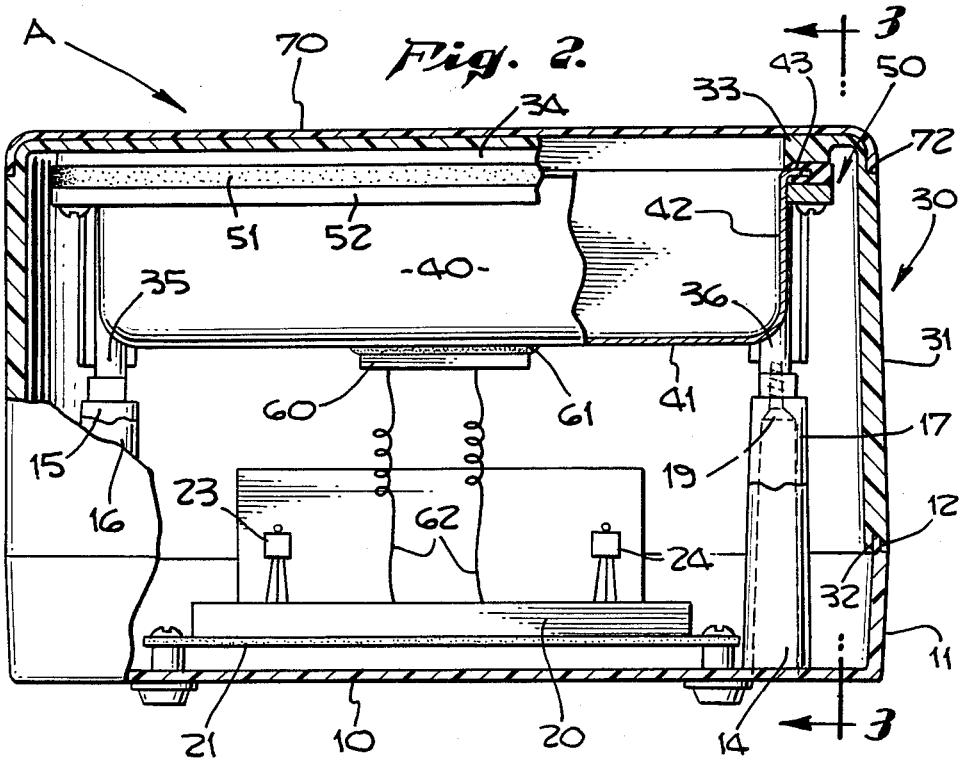
FIG. 2 is a side elevation view of the apparatus, partially in cross-section.

The base 10 is in the form of a dish which is generally elliptically shaped, but more specifically, has a rectangular central portion and two semi-circular end portions. The base is preferably formed as an integral plastic member. It has a low peripheral wall 11, FIG. 2, with a shoulder 12 formed on the outer surface of its upper circumferential edge. It also has four vertical posts 14, 15, 16, 17 which are located at the corners of a rectangular space within the peripheral wall 11 of the base. Posts 14 and 15 are seen in FIG. 2 while posts 14 and 17 are seen in FIG. 3. Each post has a hollow interior as shown by the pair of dotted lines 18 in post 15 of FIG. 2, and the upper end of the hollow part is narrowed to hold an upwardly extending screw 19, also shown in dotted lines in FIG. 2.

Electric circuit means 20 is shown in a schematic form in FIG. 2, and includes various components mounted on a plastic circuit board 21 that is supported in spaced relation above the bottom wall of base 10. A vertical metal plate 22, shown only in FIG. 2, extends upward from the rearward side of circuit board 21 as seen in that figure. Transistors 23 and 24, which are included in the circuit components, are attached to the inside vertical surface of the metal plate 22, which therefore acts as a heat sink for these transistors.

An open-topped housing 30 has a circumferential wall 31 which is shaped like the wall of the base, i.e., generally elliptically shaped but with a rectangular central portion and two semi-circular end portions. Circumferential wall 31 has a lower edge 32 notched on its downwardly facing surface so as to mate with the shoulder 12 of base 10 while at the same time forming a smooth exterior wall surface. Housing 30 also has an inturned circumferential flange 33 at the top of wall 31, and a downwardly turned circumferential rib 34 beneath the inner edge of the flange 33. These details are best shown in FIG. 4.

In addition, housing 30 has posts 35, 36, 37, 38 which extend downward from the rib 34 and, in the assembled condition of the machine, rest upon the tops of posts 14 through 18, respectively, of the base 10. As previously noted, each post of the base is hollow, and it receives a screw 19 which extends into a small threaded opening in the lower end of the corresponding post of the housing. Housing 30 is preferably formed as an integral plastic member. While its wall 31 is shown in FIG. 2 as being thicker than the wall 11 of base 10, it is in fact preferred to utilize circumferentially spaced interior ribs to perform the function of locking over the inner surface of base wall 11.

An open-topped liquid tank 40 is disposed within the housing 30, the liquid tank having a horizontal bottom wall 41 and a circumferential side wall 42 with an outwardly extending circumferential flange 43 at its upper extremity. Tank 40 is made of metal, and the juncture of its circumferential wall 42 with bottom wall 41 is smoothly curved to avoid any cleaning problem. In general, the liquid tank is disposed within the upper portion of the circumferential wall of the housing, and the circumferential flange of the liquid tank is adapted to have a mating relationship with the under surface of the housing rib. The manner of supporting the liquid tank and sealing it against liquid spillage will now be more specifically described.

In FIG. 4 the supporting and sealing mechanism is designated generally by numeral 50. An elastomeric gasket 51 fits underneath the housing rib 34 about its entire periphery. On its inner circumferential surface the gasket 51 has a groove 55 which receives the metal lip or flange 43 of the tank 40. A rigid plastic holding ring fits underneath the gasket 51. At various points about the circumference of the apparatus, there are threaded holes formed in the rib 34 of the housing 30, and corresponding holes formed in gasket 51 and holding ring 52. At each of these locations a screw 53 is used to fasten the parts together so that gasket 51 grasps the tank lip 43 in a secure liquid-sealing relationship. Therefore, the gasket is fitted above, below, and around the extremity of the tank flange.

It should also be noted from FIG. 4 that the rib 34 of housing 30 has a downwardly depending inner lip **34*a* which partly overlaps the tank flange 43** so as to minimize the amount of liquid which can actually reach the gasket.

Figure 9:
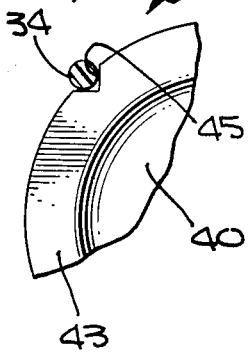
FIG. 9 is a fragmentary cross-sectional view illustrating how the housing posts provide lateral support for the liquid tank.

As shown in FIG. 9, the tank flange 43 has a notch 45 formed in each of four locations on its outer edge, so as to fit about a corresponding one of the housing posts 35–38.

An electro-mechanical transducer 60 is secured to the under surface of the bottom wall 41 of liquid tank 40. The transducer is secured to the tank by means of a layer of epoxy glue 61, FIG. 2. Wires 62 connect the transducer to the electric circuit 20 which drives it in a vibration pattern at an ultrasonic frequency. A timer 80, FIGS. 1 and 3, permits manual selection of the period of time that the cleaner is to operate.

The effect of the firmly attached sets of posts 14–17 and 35–38, in conjunction with the attached peripheral walls 11 and 31, is to provide a double-walled supporting structure for the liquid tank. Furthermore, the notches 45 in the tank flange 43 are laterally supported by corresponding ones of the housing posts 35–38, respectively. This very secure support structure tends to restrict the vibratory movement of the tank. The walls of the tank must of course move to some extent in order to create the ultrasonic vibrations in the liquid inside the tank where parts are being cleaned.

A removable cover 70 is preferably formed as an integral plastic member. Its downwardly depending peripheral flange 71 is received by a shoulder 72 formed in the exterior surface of the wall 31 of housing 30, as seen in FIG. 2. Tabs 75, FIG. 3, permit convenient removal of the cover.

The apparatus is assembled in the following manner. The electric circuit 20 and timer 80 are mounted on the circuit board 21, which is then secured inside the base 10. Gasket 51 is placed about the lip 43 of tank 40. Gasket 51 is placed against housing rib 34, and support member 52 is placed below the gasket. Then screws 53 are installed in order to secure the tank 40 to the housing. This attachment also brings the tank flange notches 45 into secure engagement with corresponding housing posts. Wires 62 are attached to the transducer 60 and it is glued to the bottom of tank 40. Then housing 30 is placed over the base 10, the assembly is turned upside down, the two sets of posts are placed in longitudinal alignment, and screws 19 are installed to secure the two sets of posts together.

In operation, the tank 40 is filled with a selected type of cleaning fluid, such as one specially adapted to cleaning dentures, or one specially adapted to cleaning jewelry. Then the parts to be cleaned are placed in the tank, the timer is set, and the cleaner operates for the period of time that was chosen.

DETAILED DESCRIPTION

JEWELRY BASKET & METHOD OF USE, FIGS. 5–8.

Jewelry basket 100 has generally the shape of a rectangular box. More specifically, it is an open-topped auxiliary tank having a generally rectangular configuration in the horizontal plane and having a length which is less than the length of liquid tank 40 but greater than the width of liquid tank 40. Basket 100 has a bottom wall 101 and openings 102 in said bottom wall which permit the entry into the basket of the cleaning fluid that occupies liquid tank 40. Short feet 103 on the bottom wall elevate it sufficiently that the cleaning fluid has no difficulty entering the openings 102.

Figure 6:
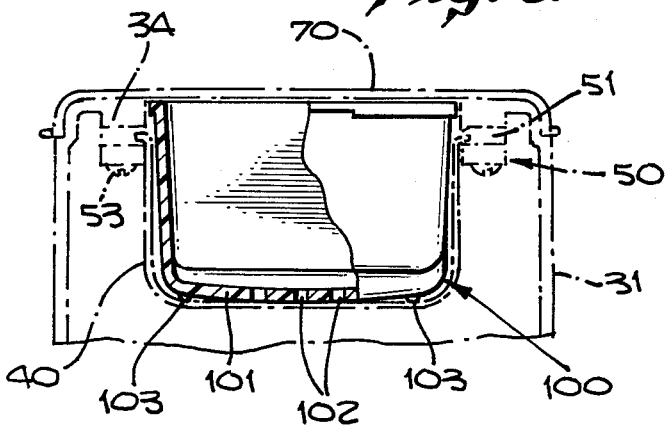
FIG. 6 is an end view, partly in phantom lines and partly in cross-section, showing how the jewelry basket is located within the apparatus.
Figure 7:
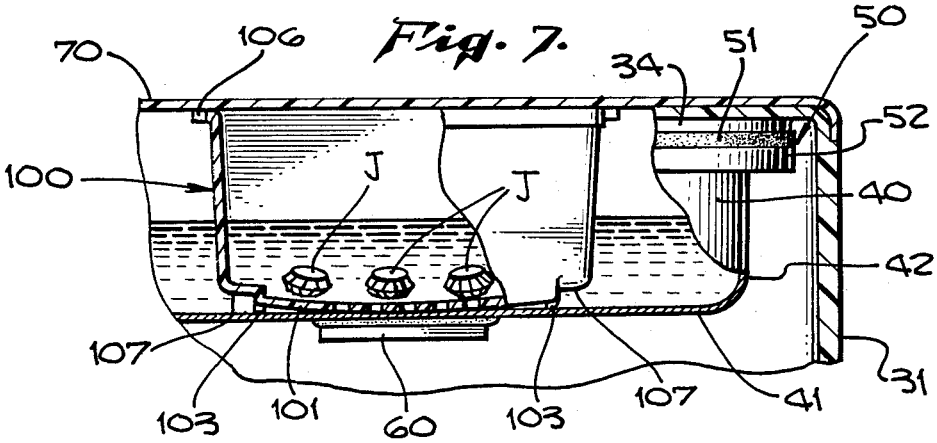
FIG. 7 is a longitudinal cross-sectional view of the apparatus, including the jewelry basket, during the actual operation of cleaning jewelry.

When jewelry is being cleaned, basket 100 fits lengthwise in liquid tank 40 in longitudinal alignment therewith, as shown in FIGS. 6 and 7. Items of jewelry are designated by letter J in FIG. 7.

Figure 8:
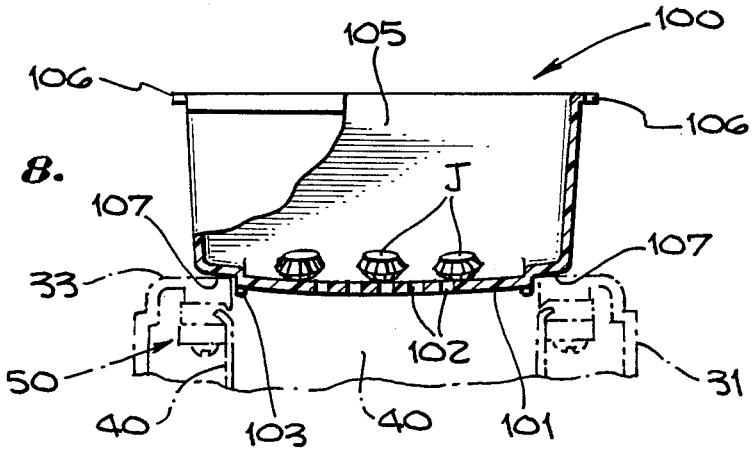
FIG. 8 is an elevation view showing the position to which the jewelry basket is raised for purpose of drying its contents.

The basket has a peripheral wall 105 with finger-gripping tabs 106 on its ends so that it may be lifted upward from and out of the liquid tank. When the basket is removed from the liquid tank, it is adapted to be disposed crosswise of the liquid tank and resting above the liquid tank, as shown in FIG. 8. The bottom wall of the basket has recessed ends 107 which interfit with the flange 33 of housing 30 in supporting engagement therewith, to maintain the desired position of the jewelry basket. The openings 102 then permit the cleaning fluid to drain from the basket back into the liquid tank 40. Basket 100 is preferably integrally formed of plastic material.

While the presently preferred form of the invention has been disclosed in considerable detail in order to comply with the patent laws, it will be understood that the spirit and scope of the invention are defined only in the appended claims.

What I claim is:

1. An ultrasonic cleaning apparatus comprising:

a base;

an open-topped hollow housing supported upon said base and extending upwardly therefrom, said housing having a circumferential side wall, an inturned flange at the top of said side wall, and a downwardly turned circumferential rib beneath the inner edge of said flange;

electric circuit means supported on said base within the lower portion of said housing;

an open-topped liquid tank disposed within the upper portion of said housing, said liquid tank having a bottom wall, and a circumferential side wall with an outwardly extending circumferential flange at its upper extremity, said circumferential flange having a mating relationship with the under surface of said housing rib;

elastomeric gasket means disposed between the upper surface of said liquid tank flange and the under surface of said housing rib;

an electro-mechanical transducer secured to the under surface of said bottom wall of said tank, said electric circuit means being coupled to said transducer for drivingly energizing the same; and removable means securing said tank flange and said housing rib together to thereby compress said gasket means therebetween so as to prevent any liquid from spilling from said tank onto said electric circuit means.

2. The apparatus of claim 1 wherein said removable securing means includes a mounting ring disposed underneath said circumferential flange of said tank, and screw means extending upwardly through said mounting ring and said tank flange and into holes formed in said housing rib.

3. The apparatus of claim 1 wherein said gasket means includes a continuous gasket which completely encircles said tank flange, which has a groove on its inner circumferential surface, and which is fitted above, below, and around the extremity of said tank flange.

4. The apparatus of claim 1 wherein said base has a plurality of upwardly extending posts secured thereto, said housing rib has a plurality of downwardly extending posts secured thereto, the upper ends of said base posts are secured to the lower ends of said housing posts, said base has a circumferential side wall, and the lower edge of the circumferential side wall of said housing mates with said circumferential wall of said base.

5. The apparatus of claim 4 wherein said tank flange also has notches on its outer circumferential edge which are engaged by respective ones of said housing posts for laterally supporting said liquid tank.

6. An ultrasonic cleaning apparatus comprising:

a base having an upstanding circumferential side wall, said base also having a bottom wall with a plurality of upwardly extending posts secured thereto;

an open-topped hollow housing having a circumferential side wall being supported upon said side wall of said base in mating relationship therewith and extending upwardly therefrom, said housing also having an inturned circumferential flange at the top of said side wall, and a downwardly turned circumferential rib beneath the inner edge of said flange;

said housing rib having a plurality of downwardly extending posts secured thereto, the upper ends of said base posts being secured to the lower ends of said housing posts;

an open-topped liquid tank disposed within the upper portion of said housing, said liquid tank having a bottom wall and a circumferential side wall with an outwardly extending circumferential flange at its upper extremity, said circumferential flange having a mating relationship with said housing rib;

said tank flange also having notches on its outer circumferential edge which are engaged by respective ones of said housing posts for laterally supporting said liquid tank;

said base and said housing each being separately integrally formed of plastic material, and said liquid tank being made of metal; and an electro-mechanical transducer secured to the under surface of said bottom wall of said tank for driving said tank in horizontal vibrations.

7. The ultrasonic cleaning apparatus of claim 6 which further includes electric circuit means supported on said base within the lower portion of said housing;

elastomeric gasket means disposed between the upper surface of said liquid tank flange and the under surface of said housing rib;

said electric circuit means being coupled to said transducer for drivingly energizing the same; and removable means securing said tank flange and said housing rib together to thereby compress said gasket means therebetween so as to prevent any liquid from spilling from said tank onto said electric circuit means.

8. The ultrasonic cleaning apparatus of claim 6 which further includes a removable cover adapted to fit over said liquid tank and the top of said housing, and a basket removably disposed within said liquid tank for receiving items to be cleaned;

said basket having openings for the entry of cleaning fluid therein, being of an elongated configuration, and having recessed portions on its bottom ends adapted to be supported upon said tank flange when items it contains have been cleaned and the basket is removed from said tank to allow the cleaning fluid to drain therefrom into said tank.

9. In an ultrasonic cleaning apparatus having an open-topped liquid tank which has a peripheral side wall and which is of generally rectangular configuration in the horizontal plane with predetermined length and width dimensions inside said peripheral wall, a basket for holding jewelry or the like while it is being cleaned:

said basket being in the form of an open-topped auxiliary tank having a generally rectangular configuration in the horizontal plane and having a length which is less than the length of said liquid tank but greater than its width;

said basket having a bottom wall and having openings in said bottom wall adapted to permit the entry therein of a cleaning fluid from said liquid tank;

said basket in its operative position being disposed within said liquid tank in longitudinal alignment therewith;

said basket having a peripheral side wall with finger gripping means on the upper extremity thereof so that it may be lifted upward out of said liquid tank;

said basket when removed from said liquid tank being adapted to be disposed crosswise of said liquid tank and resting above the upper extremity of said peripheral wall thereof;

the bottom wall of said basket having recessed ends which interfit with the upper extremity of said peripheral wall of said liquid tank in supporting engagement therewith; and said openings then permitting the cleaning fluid to drain from said auxiliary tank back into said liquid tank.

10. The apparatus of claim 9 wherein said basket also has feet on its bottom wall which, when said basket is inside said liquid tank, support said basket in a raised position relative to the bottom wall of said liquid tank.

* * * * *